United States Patent [19]

Mayborg et al.

[11] 4,316,674

[45] Feb. 23, 1982

[54] KEYLEVER PAWL TUBE SPRING AND KEYBOARD UTILIZING A KEYLEVER PAWL TUBE SPRING

[75] Inventors: Charles C. Mayborg; Delbert L. Teel, II, both of Lexington, Ky.

[73] Assignee: International Business Machines Corporation, Armonk, N.Y.

[21] Appl. No.: 136,001

[22] Filed: Mar. 31, 1980

[51] Int. Cl.[3] ..... B41J 5/14

[52] U.S. Cl. ..... 400/478; 400/472; 200/5 A

[58] Field of Search ..... 400/50, 51, 52, 666, 400/161, 161.1, 367, 368, 369, 375, 375.1, 375.2, 375.3, 375.4, 472, 478; 267/153, 140, 141; 84/433, 434; 235/145 R; 200/153 A

[56] References Cited

U.S. PATENT DOCUMENTS

| | | | |
|---|---|---|---|
| 3,032,168 | 5/1962 | Reynard | 400/666 |
| 3,086,635 | 4/1963 | Palmer | 400/52 |
| 3,537,562 | 11/1970 | Caudill et al. | 400/52 X |
| 3,603,983 | 9/1971 | Mitchell | 235/145 R |
| 3,915,277 | 10/1975 | Cappotto et al. | 400/496 X |

*Primary Examiner*—Steven A. Bratlie
*Assistant Examiner*—Charles Pearson
*Attorney, Agent, or Firm*—Laurence R. Letson

[57] ABSTRACT

A hollow tubular rubber or rubberlike deformable member is supported by a plurality of character keylevers in a typewriter keyboard and constrained against movement within the typewriter by supporting surfaces on the keylevers such that the tube engages the keylever pawls carried by the keylevers. As the keyboard of the typewriter operates, an interposer will force the keylever pawl rearward to provide complete restoration of the selection interposer. If the pawl did not rotate and the keylever is still in its depressed position upon the completion of the keyboard cycle, the selection logic would not be cleared and any following keylever input would result in a malselection. Also, interposer loading would prevent keylever restoration. The force of the interposer against the front edge of the keylever pawl will force the keylever pawl to pivot about its pivot stud and to locally compress the tube spring, formed out of a resilient pliable rubber-like material. Upon the restoration of the keylever to its rest position and withdrawal of the keylever pawl from engagement with the interposer stem, the forces generated within the tube spring during local deformation will be released and will act to restore the keylever pawl to its normal at rest position. The tube spring extends across the entire keyboard engaging all keylever pawls in the keyboard, thus eliminating the need for a separate spring or spring finger to be engaged with each keylever pawl and each keylever.

2 Claims, 4 Drawing Figures

KEYLEVER PAWL TUBE SPRING AND KEYBOARD UTILIZING A KEYLEVER PAWL TUBE SPRING

BACKGROUND OF THE INVENTION

This invention deals with typewriter keyboards and, particularly, with the restoring of parts in the typewriter keyboard to their normal at rest position. Prior typewriter keyboards, such as that found in the IBM SELECTRIC typewriter, utilize keylevers which carry on the keylever itself pivotally mounted, a keylever pawl or dobber. The keylever pawl is maintained in its rest position by a comb or leaf spring or coil spring connected between the pawl and the keylever. When a keylever is depressed to select a character, the keylever pawl engages the stem of an interposer lying underneath the selected keylever. The pawl depresses the interposer into its selected, operative position and upon the cycling of the keyboard to effect selection by the interposer, the interposer will, upon restoration, engage the keylever pawl forcing it to move out of the path of the interposer stem and deflect the spring acting on the pawl. As the keylever is restored, the pawl restore spring will restore the pawl into its normal active position over the stem of the interposer. By moving the keylever pawl out of its normal position, the interposer is allowed to restore and a keylever inadvertently held depressed during the keyboard cycle will not impact the time necessary for the next selection.

The individual springs attached to the keylever pawl create assembly problems in the connecting of the springs between the keylever pawl and the key stem in tight fitting conditions and the handling of multiple springs requires tedious and time consuming labor. Comb springs require expensive tooling and extremely careful handling and assembly.

OBJECTS OF THE INVENTION

It is an object of the invention to eliminate the multiple springs required for restoring the keylever pawl with respect to a keylever in a typewriter keyboard.

It is a further object of the invention to simplify assembly of a typewriter keyboard by incorporating a single resilient tube spring to restore keylever pawls.

The disadvantages of the prior art are overcome and the objects of the invention accomplished by the insertion beneath the keylevers and held in an operative spacial relationship with the keylever pawl, of a hollow rubber-like tubular member capable of deformation under relatively low forces to locally collapse the tube and which is sufficiently resilient to provide a restore force to the keylever pawl when released.

The hollow tube is provided with end openings to the atmosphere such that the only forces encountered by the keylever pawl are the forces of local deformation of the tube as the tube seeks to return to its original undeformed position. The force generated thereby is transmitted to the keylever pawl to return the keylever pawl to its normal, at rest position. The tube spring is inserted across the entire keyboard and, thus, the one tubular member is available to act against all keylever pawls, regardless of their relative lateral position on the keyboard.

Figure 1:
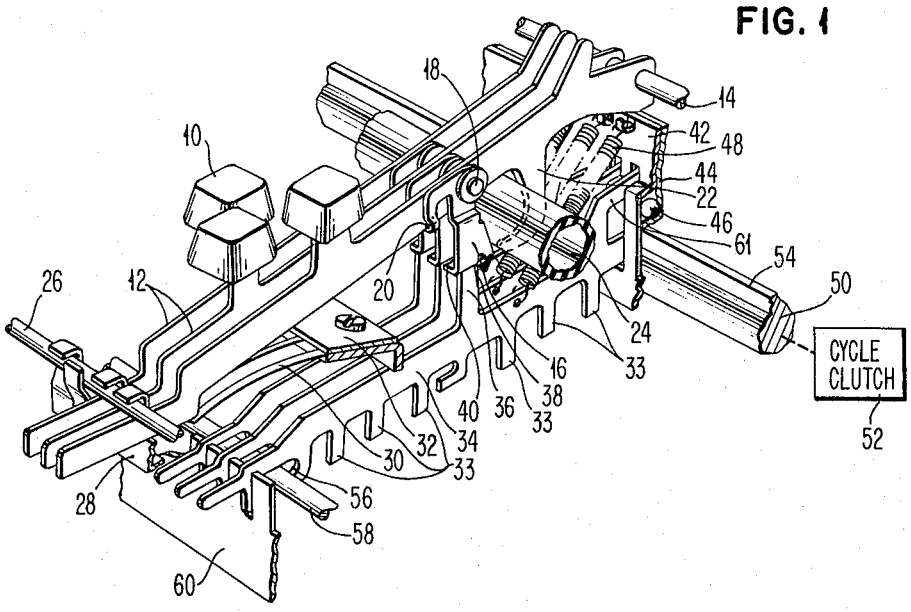
FIG. 1 is a prospective view of a portion of a keyboard incorporating the keylever pawl tube spring.
Figure 2:
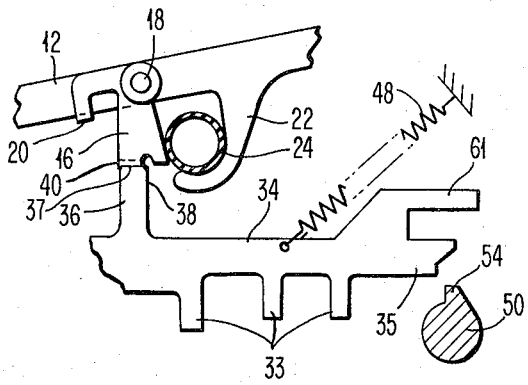
FIG. 2 is an end view of the keyboard portion showing the keylever pawl tube spring relationship with the keylever and interposer in a normal at rest position.
Figure 3:
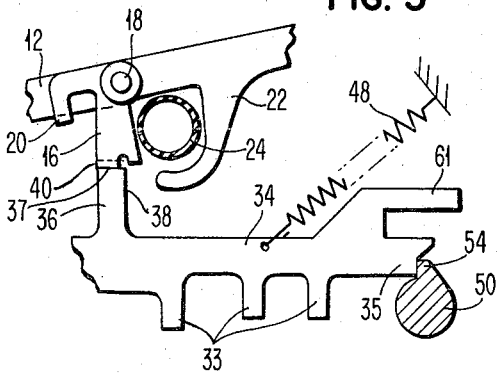
FIG. 3 illustrates positions of elements of the keyboard when the keylever and interposer are depressed to effect selection of a desired character.
Figure 4:
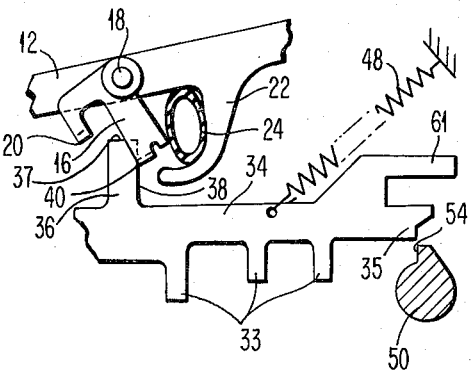
FIG. 4 illustrates the end view of the keyboard with the interposer causing local deformation of the tube spring by its action upon the keylever pawl upon restoration of the interposer before the release of the keylever.

A more complete and detailed understanding of the structure and operation of the invention may be had referring to the figures of the drawing and the detailed description below.

The keyboard of an office machine, such as a typewriter, has key buttons 10 and keylevers 12 for entering the information desired into the typewriter or office machine. The keylever 12 is typically pivotally mounted on pivot 14. Pivot 14 extends across the entire keyboard and is a common pivot for all keylevers 12. Carried on keylever 12 is keylever pawl 16. Keylever pawl 16 is mounted for pivotal movement on pivot 18. The keylever pawl 16 is also provided with a stop lug 20 to prevent the keylever pawl 16 from moving past a predesignated desired position with respect to the keylever 12. The stop lug 20 is effective to stop the movement of the keylever pawl 16 in a clockwise direction as illustrated in the drawing to align keylever pawl 16 with interposer stem 36.

Extending from the underside of keylever 12 is a support appendage 22 formed into a generally hooked shape. This support appendage 22, in conjunction with similar support appendages 22 on other keylevers, constrains the movement of tube spring 24. Tube spring 24 rests on the upper surface of the support appendage 22 and is effectively trapped between keylever pawl 16 and appendage 22. Appendage 22 is provided with sufficient length to insure a clearance, above tube spring 24 and beneath the underside of keylever 12, sufficient that keylever 12 may be rotated about pivot 14 to its activated position without engaging the top of tube spring 24. The up position or normally restored position of the keylever 12 is defined by the keylever upstop 26. Lateral stability for the keylever 12 is provided by the front guide comb 28 which restricts the extent of movement of the keylever 12 laterally and downward. Restoration of the keylever 12 upon release is accomplished by the keylever return spring 30 which is a leaf spring engaging the underside of keylever 12 and grounded at the other end by return spring bracket 32 to a portion of the frame of the typewriter keyboard.

Positioned beneath each of the keylevers 12 on the keyboard is an interposer 34. The interposer 34 is provided with a plurality of code lugs 33 which may be removed or left intact depending on the character coding desired from each specific keylever. Extending upwardly from the interposer 34 is a stem 36. The stem 36 has a flat area 37 on the end thereof for the engagement of the underside of keylever pawl 16. In addition, the stem 36 has a rear surface 38 which is engageable with the front surface 40 of keylever pawl 16.

Interposer 34 is constrained against lateral movement while, at the same time, being allowed longitudinal movement by a guide comb 42. Guide comb 42 and bracket 44 together form a race within which balls 46 may be placed to interlock against more than one interposer 34 being displaced into the ball interlock formed by guide comb 42, bracket 44 and balls 46.

The filter shaft 50 may be cyclically driven through a conventional single cycle clutch 52 or oscillated as a bail by appropriate linkage. The rib 54 or flute 54 of filter shaft 50 will impact interposer 34, which has been depressed, to provide the drive force necessary to translate interposer 34 longitudinally for character selection coding. Interposer 34 is provided with an aperture 56 through which interposer fulcrum shaft 58 extends.

Interposer fulcrum shaft 58 provides a sliding and pivotal support for the interposer 34. The front interposer guide comb 60 provides lateral and rotational support to keep the character interposer 34 in its appropriate relationship with the other interposers on the keyboard.

Return spring 48 acts to pull interposer 34 into its restored position upon being freed of external forces from filter shaft 50 and keylever pawl 16.

The general operation of the keyboard incorporating tube spring 24 is quite similar to other previously marketed keyboards. As key button 10 and keylever 12 are depressed by the operator, the keylever 12 pivots around pivot 14, thus causing the keylever pawl 16 to move downward. As keylever pawl 16 moves downward, it engages the top 37 of interposer stem 36. This, in turn, causes the interposer 34 to rotate in a clockwise direction about interposer fulcrum shaft 58 lowering the rear end of the interposer such that the nose 61 of the interposer 34 will be forced between balls 46 contained in the ball tube formed by guide comb 42 and bracket 44, thus interlocking the keyboard against the depression of a subsequent carrier interposer. With the interposer 34 depressed, the rear end 35 of the interposer 34 is then engageable by flute 54 of filter shaft 50 upon its next cyclic rotation. The interposer 34, upon engagement by flute 54, will translate longitudinally and generally leftward in the drawings to effect the selection coding of the character selected.

Upon disengagement of the flute 54 from the end 35 of the interposer 34, the restore spring 48 will urge the interposer 34 upward and toward the right to its rest position. As the interposer 34 restores to its rest position and assumming that keylever 12 remains depressed by the operator's force on key button 10, the rear surface 38 of stem 36 will engage the front surface 40 of keylever pawl 16. Upon the restore spring 48 pulling interposer 34 completely to its home or at rest position, the spring force is transmitted through stem 36 to keylever pawl 16 causing the keylever pawl 16 to be displaced counter clockwise about pivot stud 18.

The rear surface of keylever pawl 16 will then engage the external periphery of tube spring 24 causing tube spring 24, made of a resilient rubber or similar material to locally collapse under the keylever pawl force. The keylever pawl will continue to deform tube spring 24 until such time as the operator removes the force on key button 10 allowing keylever 12 to rise about its pivot 14 and engage the keylever upstop 26. As keylever 12 is restored by keylever return spring 30, the force of keylever return spring 30 having been stored during the depression of keylever 12, the front edge 40 keylever pawl 16 will disengage the rear surface 38 of interposer stem 36. As this disengagement occurs, the resilient nature of tube spring 24 and the forces generated in the wall of the tube spring 24 by keylever pawl 16 will act to restore the resilient tube spring 24 to its normal cross sectional shape, thus forcing keylever pawl 16 in a clockwise direction to restore it to its normal at rest position defined by the engagement of stop lug 20 with the underside of keylever 12.

The single tube spring, made of rubber or other easily deformable but resilient material, will provide a restore force to the keylever pawl 16 while, at the same time, providing restore forces to other keylever pawls on other keylevers 12 which may as yet not have been returned to their normal at rest position. The tube spring is a simple reliable improvement over the multiple keylever pawl springs heretofore commonly found in typewriter keyboards.

We claim:

1. A keyboard comprising:

a plurality of keylevers, each said keylever having a depending support member on said keylever, an interposer associated with each of said keylevers and having at least a normal position, a keylever pawl pivotally mounted on each of said keylevers to transfer motion of said keylevers to said interposers and to, under the influence of said interposers, pivot out of motion transferring relation to allow said interposers to restore to said normal position, and a resilient deformable, open ended, tubular restore member deformable in cross section by said pawl during said pivoting of said pawl, said member being supported by said depending support member, and positioned with the axis thereof transverse to said keylever to provide the only resilient restore force to said pawl.

2. In a typewriter keyboard, in combination:

a keylever, pivotally mounted on said keyboard for movement from a rest position to a depressed position, a keylever pawl pivotally mounted on said keylever, a depending support member on said keylever, a deformable open ended resilient tubular member having a continuous wall, supported by said support member and engageable and deformable by said keylever pawl an interposer having a stem, said interposer having an activated position and rest position, a spring for restoring said interposer to said rest position, said keylever pawl engageable with said interposer stem to transfer said movement of said keylever to said interposer, said interposer stem engageable with said keylever pawl upon restoration of said interposer while said keylever remains in said depressed position, to pivotally displace said pawl against said tubular member to resiliently store energy therein through deformation, said tubular member being the sole resilient member acting to retain said pawl in its nondisplaced position, said interposer stem extending to a height sufficient to be disengaged by said keylever pawl only upon return of said keylever and said keylever pawl each said keylever having a depending support member on said keylever, carried thereby to said rest position thereof whereby said disengagement releases said stored energy to return said pawl to a nondisplaced position.

* * * * *